US007533648B2

(12) United States Patent
Möller et al.

(10) Patent No.: US 7,533,648 B2
(45) Date of Patent: May 19, 2009

(54) COMPRESSION IGNITION INTERNAL COMBUSTION ENGINE HAVING COMBUSTION CHAMBERS FOR HIGH IGNITION PRESSURES

(75) Inventors: Heribert Möller, Sachsen (DE); Mathias Wacker, Nürnberg (DE); Peter Spaniol, Zirndorf (DE)

(73) Assignee: MAN Nutzfahrzeuge AG (DE)

( * ) Notice: Subject to any disclaimer, the term of this patent is extended or adjusted under 35 U.S.C. 154(b) by 30 days.

(21) Appl. No.: 11/546,225

(22) Filed: Oct. 11, 2006

(65) Prior Publication Data

US 2007/0079776 A1 Apr. 12, 2007

(30) Foreign Application Priority Data

Oct. 11, 2005 (DE) ..... 10 2005 048 566

(51) Int. Cl.
*F02F 1/36* (2006.01)

(52) U.S. Cl. ..... 123/193.3

(58) Field of Classification Search .... 123/193.1–193.5
See application file for complete search history.

(56) References Cited

U.S. PATENT DOCUMENTS 3,176,666 A * 4/1965 Whitehead ..... 123/41.82 R
4,121,550 A * 10/1978 Wand et al. ..... 123/41.31
4,800,853 A * 1/1989 Kraus et al. ..... 123/193.4
6,874,479 B2 * 4/2005 Fuchs ..... 123/470

* cited by examiner

*Primary Examiner*—Marguerite J. McMahon
(74) *Attorney, Agent, or Firm*—Robert W. Becker; Robert W. Becker & Assoc.

(57) ABSTRACT

A compression ignition internal combustion engine having at least one combustion chamber for high ignition pressures. Each combustion chamber comprises a cylinder bore in the crankcase or a cylinder liner in the cylinder bore, a piston, and a cylinder head. Spaces for conveying coolant are disposed in the crankcase such that coolant flows about walls of the cylinder bore or a liner. The cylinder head has coolant chambers. The internal combustion engine has a separate cooled plate disposed between the combustion chamber and the cylinder head. The cooled plate forms a surface cover of the combustion chamber and is connected in a positively engaging and gas tight manner with the crankcase and/or the cylinder liner. Valve seats for at least one inlet valve and at least one outlet valve are disposed in the cooled plate, and at least one injection valve extends through the cooled plate.

27 Claims, 7 Drawing Sheets

COMPRESSION IGNITION INTERNAL COMBUSTION ENGINE HAVING COMBUSTION CHAMBERS FOR HIGH IGNITION PRESSURES

The instant application should be granted the priority date of Oct. 11, 2005 the filing date of the corresponding German patent application 10 2005 048 566.9.

BACKGROUND OF THE INVENTION

The present invention relates to a self-ignition or compression ignition internal combustion engine having combustion chambers for high ignition pressures.

With vehicle engines that are customary these days, especially engines for commercial vehicles, ignition pressures are customary that place very high requirements on the sealing of the combustion chambers and expose the components that are adjacent to the combustion chamber, especially the cylinder head, to very high thermal and mechanical stresses. As a consequence of these high stresses, the cooling effect that can be made available to the combustion chamber cover via the cooling channels in the cylinder head is often not sufficient for an adequate cooling, especially in the regions between the valves. As a result, so-called web or element cracks can occur between the valve openings in the cylinder head and destroy the cylinder head and hence the engine.

In parallel to this existing problem, in order to achieve the emission values required in the future on the one hand, and the constantly increasing requirements for the per liter efficiency of the internal combustion engines while at the same time reducing the weight on the other hand, it would be absolutely necessary to increase the ignition pressures to a magnitude of up to 300 bar, which is nearly double the present standard. Such requirement, at acceptable expense of the material that can be used, cannot be fulfilled with today's customary engine constructions.

It is therefore an object of the present invention to provide an internal combustion engine that is able to cope with high ignition pressures at acceptable structural expense.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
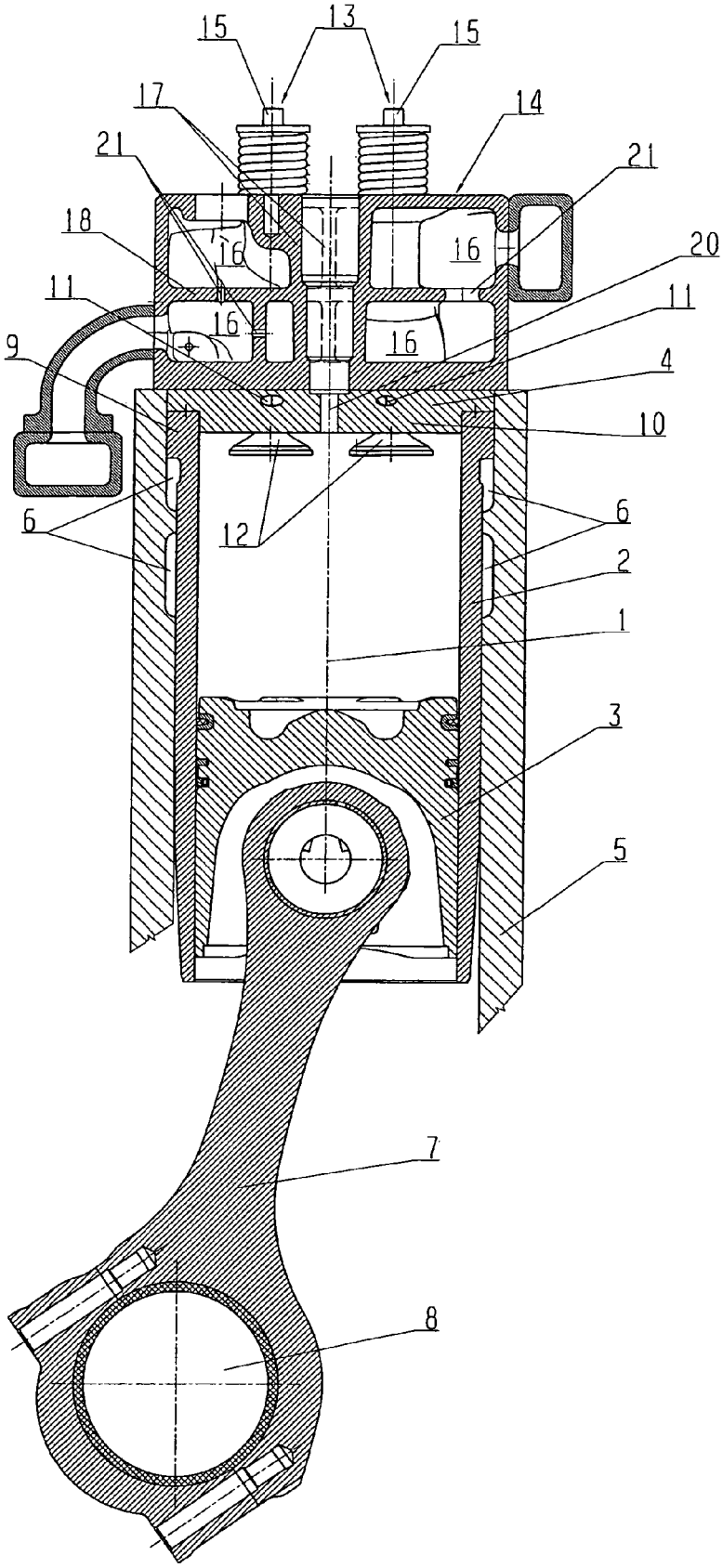
FIG. 1 is a cross-sectional view, taken along the line A-A in FIG. 3, of a combustion chamber of a partially illustrated internal combustion engine.

The present application describes a compression ignition internal combustion engine having at least one combustion chamber for high ignition pressures, wherein each combustion chamber comprises a cylinder bore disposed in a crankcase of the internal combustion engine or a cylinder liner disposed in the cylinder bore, a piston that is guided in the cylinder bore or cylinder liner, and a cylinder head disposed across from the piston, wherein spaces that are adapted to convey coolant are disposed in the crankcase such that coolant can flow about a portion of the walls of the cylinder bore or cylinder liner on a side remote from the combustion chamber, wherein the cylinder head is associated with at least one of the combustion chambers and is provided with coolant chambers through which coolant is adapted to flow, wherein gas-reversing valves, at least one injection valve, and guides for at least one inlet valve and at least one outlet valve are disposed in the cylinder head for each combustion chamber, wherein the internal combustion engine further comprises a separate cooled plate that is disposed between the combustion chamber and the cylinder head, forms a cover surface of the combustion chamber, and is connected in a positively engaging and gas-tight manner with the crankcase and/or the cylinder liner, wherein valve seats for the at least one inlet valve and at least one outlet valve are disposed in the cooled plate, and wherein at least one injection valve is adapted to extend through the cooled plate.

The present application proceeds from the idea that the combustion chamber seal that is these days customarily undertaken by the underside of the cylinder head will future engines having greatly increased ignition pressures have to be undertaken by a separate component. In this connection, involved is a separate cooled plate that is disposed between the combustion chamber and the cylinder head, that forms the cover surface of the combustion chamber, that is connected in a positive and gas tight manner with the crankcase and/or the cylinder liner, in which is disposed the valve seats of at least one inlet valve and at least one outlet valve, and through which extends the at least one injection valve. The advantage of such a component is, on the one hand, that the positive connection of the cooled plate with the crankcase and/or with the cylinder liner can be effected directly at the combustion chamber boundary, as a result of which the flexure that can occur when pressure builds up can already be considerably minimized due to the significantly smaller spans relative to the cylinder heads that are conventional these days; on the other hand, the use of this component, which is separate from the crankcase, the cylinder head, and also possibly the cylinder liner, offers entirely new possibilities with regard to the material that can be used. In this connection, the cooling of the cooled plate is effected by the coolant that is provided for cooling the crankcase in the cylinder head, so that the cooled plate can advantageously be intergrated into the existing cooling system.

A further advantage of the inventive cooled plate is that due to the better accessibility for the mechanical processing, cooling channels can be formed in the cooled plate that provide a significantly improved cooling of the cover of the combustion chamber and of the valve seats relative to conventional cylinder heads. In this connection, the cooling channels can advantageously be formed as bores that proceed from the peripheral side of the cooled plate, and that advantageously extend into the cooled plate in such a way that they intersect other bores thus form a connected system of bores. At least a portion of the bores are again closed toward the peripheral side in order to advantageously simplify the feeding and discharge of the coolant.

The supply of the cooled plate with coolant can be effected in a straightforward and hence advantageous manner if feed openings and/or discharge openings are provided in the peripheral side and/or in the projecting edge region of the flat side of the cooled plate that forms the cover surface of the combustion chamber and/or of the flat side of the cooled plate that is opposite the cover surface, and if the supply of the cooled plate with coolant is effected directly and/or via the crankcase and/or via the cylinder head. This offers the possibility of optimally adapting the coolant stream to the respective structural conditions.

The inventive cooled plate can be used not only with combustion chambers that have no liner but also with combustion chambers that have a liner disposed in a cylinder bore. When using a liner, it is particularly advantageous to use a liner having a shoulder or a collar that is supported on a ledge or abutment in the cylinder bore.

To supply the cooled plate with the coolant, it is furthermore advantageous to form the feed and discharge openings in the cooled plate as bores that correspond with appropriate openings in the cylinder head or in the shoulder of the liner or in the crankcase or in a separate coolant distribution tube, and to connect the cooling channels in the cooled plate with the coolant chambers in the cylinder head, in the crankcase or in the separate coolant distribution tube. For this purpose, sealing means can respectively be provided in the transfer region that reliably prevent an escape of the coolant.

Due to the separate configuration of the cooled plate, i.e. independent of the crankcase and the cylinder head, there is advantageously provided the possibility for freely selecting the material, so that for the cooled plate high-strength metal alloys can be used, the use of which would be prohibitive for the cylinder head or the crankcase for cost reasons or also for structural reasons. The freedom to select the material also offers the possibility, in addition to the variation of the cooled plate with inserted valve seat rings, to realize a cooled plate where the valve seats are advantageously formed into the one-piece cooled plate.

For sealing of the combustion chamber, it is furthermore advantageous to provide the cooled plate with a cylindrical extension, the outer diameter of which essentially corresponds to the inner diameter of the combustion chamber, whereby in the installed state the cylindrical extension is disposed in the interior of the cylinder bore or the liner, so that the cooled plate extends around the upper edge of the combustion chamber in an angular manner. In this connection, for the sealing it is particularly beneficial for the diameter of the cylindrical extension to be such that a press fit results between the extension and the combustion chamber diameter. Furthermore, for sealing the combustion chamber it can be advantageous to provide a seal between the part of the cooled plate that overlaps the combustion chamber and the crankcase or the liner shoulder.

The connection of the cooled plate with the crankcase or, if present, the liner shoulder is advantageously realized by securing the cooled plate to the crankcase or the liner shoulder by means of screws; in this connection, the screws are advantageously disposed as close as possible to the edge of the combustion chamber in order to minimize flexure of the cooled plate during the ignition processes. An alternative type of securement is possible for combustion chambers having a liner by providing an internal thread on the upper liner edge and an external thread on the periphery of the cylindrical extension, so that the cooled plate and liner can be threaded together, whereby the connection between liner and cooled plate is in a particularly expedient manner effected directly at the edge of the combustion chamber. A further straightforward and hence expedient possibility for connecting the cooled plate to the liner comprises welding these two components together.

To improve the efficiency of the internal combustion engine and/or the wear at the valve seats, that side of the cooled plate that faces the combustion chamber can be provided with a coating having a low thermal conductivity and/or a high resistance to wear, whereby the coating having a low thermal conductivity minimizes the heat loss of the combustion chamber gas and hence advantageously increases the efficiency, and a wear-reducing coating at the valve seats positively influences the life expectancy.

To provide different material properties in different planes of the cooled plate, it can be advantageous to build the cooled plate up of layers of parallel plates having different material properties, whereby at least one of the inwardly disposed parallel plates has recesses connected to the cooling system of the internal combustion engine. By building the cooled plate from a set of parallel plates, nor only the cooling channels but also the coolant feeds and discharges can be produced particularly easily and hence advantageously by, for example, stampings on one or more of the parallel plates. To increase the resistance of the composite to bending, adjacent plates of the set of plates can be connected to one another.

The cylinder head which adjoins the cooled plate on that side facing away from the combustion chamber, can be embodied as an individual cylinder head, which is respectively associated with one cylinder, or as a continuous cylinder head that is associated with a plurality of cylinders or all of the cylinders, whereby the cylinder head, in addition to the gas-reversing valves, contains at least one injection valve as well as the guides for the intake and outlet valves. To further minimize the flexure of the cooled plate during the ignition processes, the cylinder head is advantageously embodied in such a way that it acts with pressure upon at least the central portion of the cooled plate. To make the cylinder head as resistant to bending as possible in an advantageous manner, partitions are provided that divide the coolant chambers and extend at least perpendicular to the flat side of the cooled plate; the partitions dissipate at least those forces that occur in the center of the cooled plate into the cylinder head fastenings in the crankcase. The use of the inventive cooled plate also offers with regard to the cylinder head possibilities for the selection of material that do not exist for conventional internal combustion engines of commercial vehicles for strength reasons, so that for the cylinder head light metal alloys can be used that advantageously reduce the weight and have considerably better properties with regard to the transfer of heat.

For the control and actuation of the gas-reversing valves and the injection valves, a control and actuating module is provided that extends over a plurality of cylinders, preferably over all of the cylinders of an in-line engine or over all of the cylinders of one bank of cylinders of a V-type engine. The control and actuating module contains at least one camshaft and the actuating devices for the gas-reversing valves and the actuating devices for the injection valves. The control and actuating module is connected to the lubricant system, and has a housing cover via which the actuating devices or the gas-reversing valves and the injection valves are accessible. Also with respect to the control and actuating module that is secured to the cylinder head or heads via detachable connections, there are new possibilities for the selection of material due to the construction, which is now separate from the cylinder head. Making the control and actuating module entirely or at least partially of polymeric materials provides an advantageous reduction in weight and simplifies the manufacture as an injection molded plastic part. An intake manifold that is common to all of the combustion chambers or all combustion chambers of a bank of cylinders can advantageously be integrated into the control and actuating module.

Further specific features of the present application will be described in detail subsequently.

DESCRIPTION OF SPECIFIC EMBODIMENTS

The concept of an internal combustion engine for high ignition pressures proceeds from the basic consideration that the sealing of the combustion chambers must be functionally separated from the cylinder head in order to provide favorable geometrical conditions for the sealing, and opens up new possibilities with regard to materials that can be used. Therefore, an independent component is proposed that is disposed between combustion chamber and cylinder head, and the exclusive function of which is to close off and seal the combustion chamber relative to the cylinder head. A combustion chamber having the previously indicated concept is schematically illustrated in a cross-sectional view in FIG. 1; the path of the section plane can be seen in FIG. 3, where it is designated by the line A-A.

FIG. 1 shows a combustion chamber 1 of a compression ignition internal combustion engine that comprises a cylinder liner 2, a piston 3, and a cooled plate 4. The cylinder liner 2 is disposed in a known manner in the crankcase 5, and in the region of the combustion chamber 1 it is surrounded by recesses or spaces 6 that convey coolant for cooling the walls of the combustion chamber. The piston 3, by means of a connecting rod 7, acts upon a crankshaft 8, which is mounted in the crankcase 5 in a non-illustrated manner. At the top, the combustion chamber 1 is closed off by the cooled plate 4, which essentially has the outer diameter of a liner shoulder or collar 9 that is disposed at the cylinder head end of the cylinder liner 2. On the cooled plate 4, toward the combustion chamber 1, a cylindrical extension 10 is disposed, the diameter of which essentially corresponds to the inner diameter of the cylinder liner 2 so that the cooled plate 4 surrounds that edge of the cylinder liner 2 that is at the cylinder head end in an angular manner.

Cooling channels 11, in which a coolant circulates, are disposed in the interior of the cooled plate 4. The cooled plate 4 is connected with the cylinder liner 2 in a positively engaging and gas tight manner. Furthermore disposed in the cooled plate 4 are valve seats (not visible in FIG. 1) that cooperate with the valve heads 12 of the gas-reversing valves 13. The supply of fuel is effected via an opening 20 that extends through the center of the cooled plate 4 from that side facing away from the combustion chamber 1 toward the combustion chamber. An injection valve (not illustrated in FIG. 1) is disposed in the opening 20 in such a way that the injection valve, possibly with the interposition of a sealing means, closes off the combustion chamber 1 in a gas tight manner, with the nozzle opening of the injection valve (not illustrated) extending into the combustion chamber. The injection nozzle is held in the cylinder head 14, which adjoins the cooled plate 4 on that side that faces away from the combustion chamber 1. On that side that faces the cooled plate 4, the cylinder head 14 completely covers the cooled plate or even projects beyond it. The cylinder head 14 is secured in a conventional manner via screws or bolts (not illustrated) that extend through the cylinder head 14 in the direction toward the crankcase 5 and are secured to the crankcase. Disposed in a known manner in the cylinder head 4 are the gas channels (not illustrated) for intake air or the combustion gases, the valve guides (not illustrated) for the valve shafts 15 of the gas-reversing valves 13, and a coolant chamber 16 for the cooling of the cylinder head 14 or its accessories. The space in the cylinder head 14 is divided into a cellular structure by means of first partition walls 17, which extend perpendicular to the cooled plate 4, and second partition walls 18, which extend parallel to the cooled plate 4; on the one hand, the cellular structure enables a precise conveyance of coolant by means of connecting bores 21, and on the other hand the cellular structure has a high rigidity, which counteracts a bending or flexure of the cooled plate 4 in the ignition phase.

Figure 2:
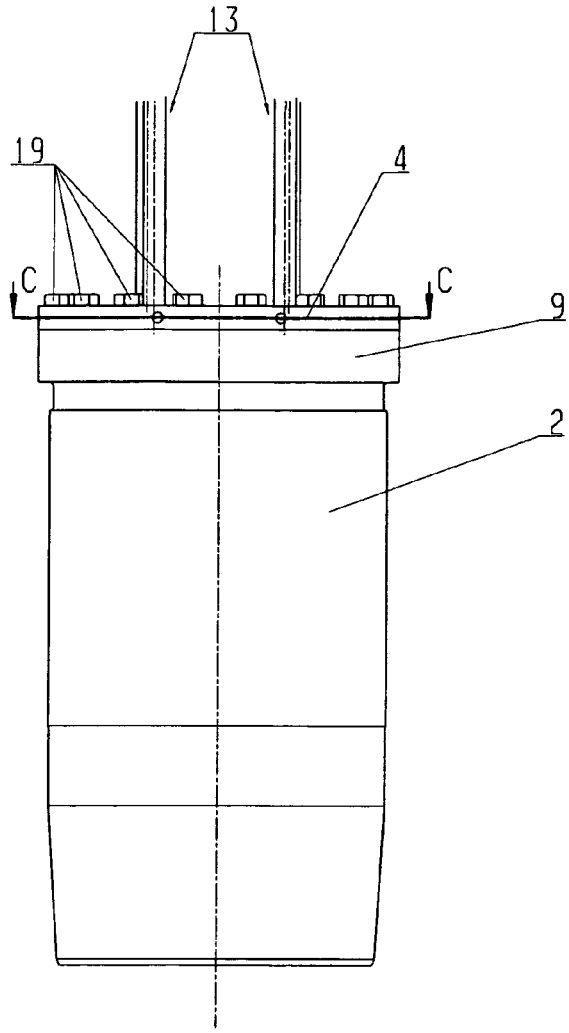
FIG. 2 is a side view from the outside of the combustion chamber of FIG. 1.
Figure 3:
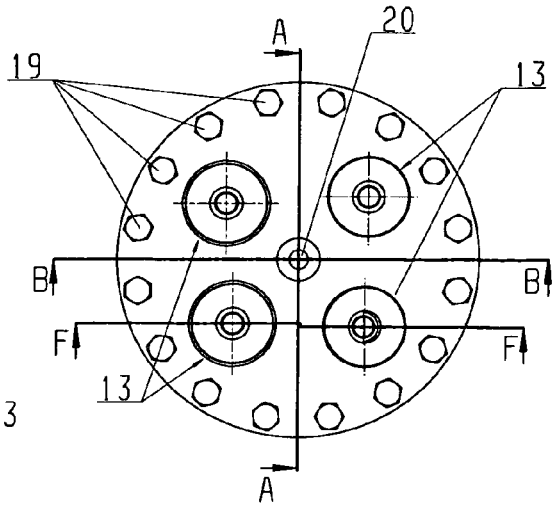
FIG. 3 is a plan view from above of the combustion chamber of FIG. 1.

An external view of the cylinder liner 2 with the cooled plate 4 placed thereon is shown in the side view of FIG. 2 and in the plan view of FIG. 3. The cooled plate 4 is secured to the liner shoulder 9 via screws 19, and corresponds in diameter to the outer diameter of the liner shoulder 9. By connecting the liner shoulder 9 with the cooled plate 4 at the combustion chamber boundary, the possible flexure of the cooled plate 4 is reduced to a minimum. As already indicated in conjunction with FIG. 1, the gas-reversing valves 13 and the opening 20 for the injection valve are disposed in the cooled plate 4.

Figure 4:
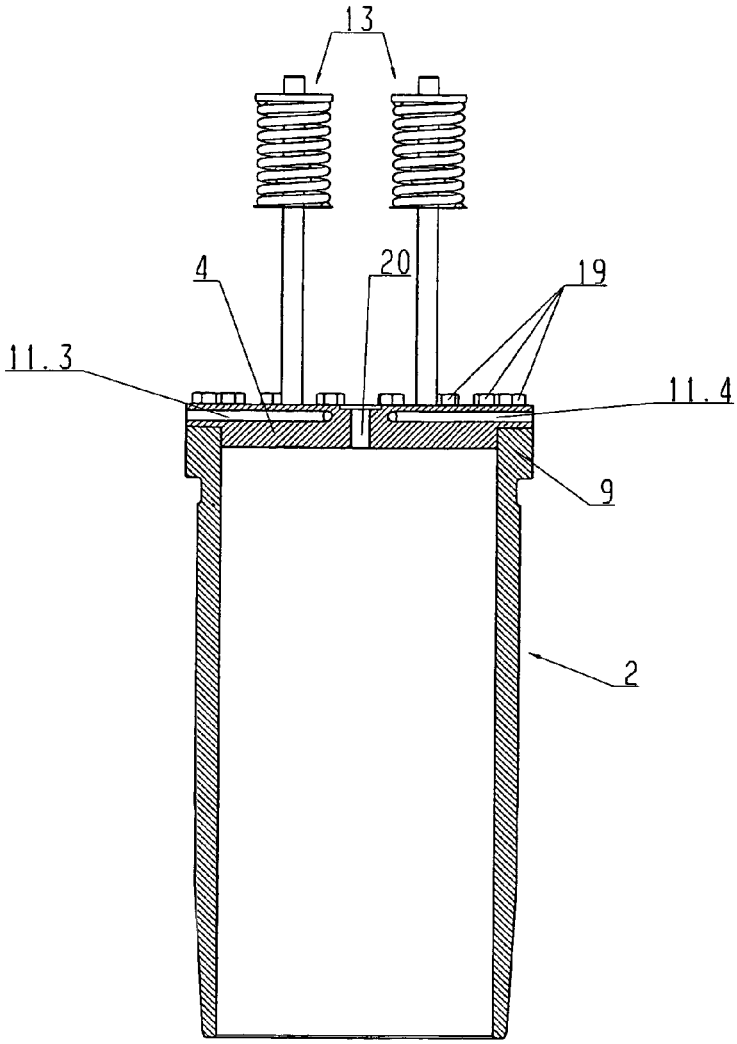
FIG. 4 is a cross-sectional view taken through the combustion chamber along the line B-B in FIG. 3.

FIG. 4 shows a cross-section through the combustion chamber taken along the line B-B in FIG. 3. Also in this illustration the cooled plate 4 is secured to the liner shoulder 9 of the cylinder liner 2 via the screws 19. Cooling channels 11 extend in the cooled plate 4, proceeding from the periphery thereof, toward the center of the cooled plate. The path of the cooling channels 11 in the cooled plate 4 is illustrated by way of example in FIG. 5, which is a cross-sectional view taken along the line C-C in FIG. 2. Proceeding from opposite sides of the periphery of the cooled plate 4, in each case bores 11.1, 11.2, 11.5, 11.6, which form two pairs of bores, extend toward one another, whereby each of the pairs of bores forms an "X", in other words, the bores of a pair of bores intersect. The arrangement of the pairs of bores relative to the arrangement of the openings for the gas-reversing valves 13, the center points of which essentially form the corners of a square, is such that the point of intersection of each pair of bores is disposed between two adjacent openings for the gas-reversing valves 13. The bores 11.1, 11.2, 11.5, 11.6 of a given pair of bores extend, as viewed from the respective point of intersection, in a direction toward the cooled plate 4, then away from one another, and intersect the bores of the oppositely disposed pair of bores along a line through the center point of the cooled plate 4. A respective single bore 11.3, 11.4 encounters these two points of intersection of the pairs of bores, with these individual bores also proceeding from the periphery of the cooled plate and, offset by 90° relative to the X-shaped pair of bores, extending between two adjacent openings of the gas-reversing valves 13. The thus-formed network of connected bores 11.1-11.6 forms the cooling channels 11, which, as will be discussed in detail subsequently, can be connected with the cooling system of the internal combustion engine in various ways. Due to the selected path of the bores 11.1-11.6, an efficient cooling of the critical region between the openings of the gas-reversing valves 13 and between these openings and the opening 20 for the injection valve is achieved, so that so-called web or element cracks are reliably avoided.

Figure 5:
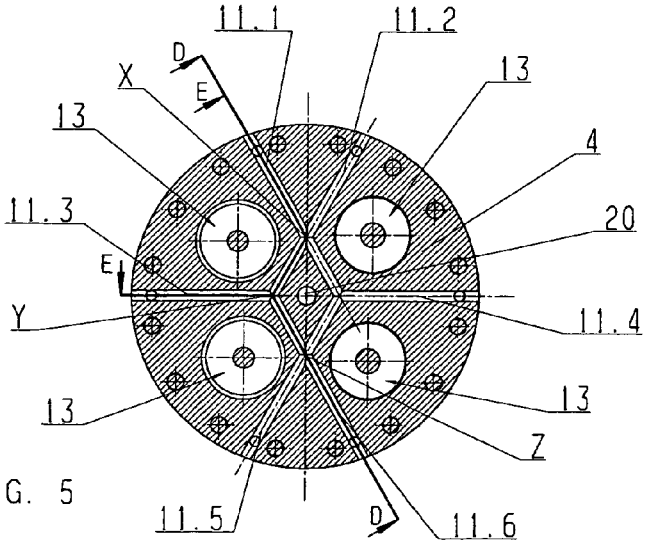
FIG. 5 is a cross-sectional view through the cooled plate that closes off the combustion chamber from above taken along the line C-C in FIG. 2.
Figure 6:
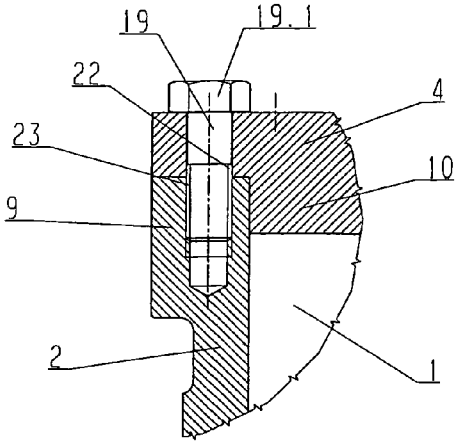
FIG. 6 is a first detailed illustration of the connection between cooled plate and liner.

The screw-connection of the cylinder liner 2 with the cooled plate 4, previously described in conjunction with FIGS. 1 to 5, is shown in a detailed cross-sectional view in FIG. 6. The cooled plate 4, which closes off the combustion chamber 1 in a direction toward the cylinder head 14 (not illustrated in FIG. 6), is disposed on the cylinder liner 2 in the region of the liner shoulder 9 and surrounds the inner edge of the liner shoulder 9 in an angular manner. Extending through a continuous bore 22, the screw 19 cooperates with a corresponding thread 23 in the liner shoulder 9 and tightens the cooled plate 4 against the liner shoulder. To seal the combustion chamber 1, the diameter of the cylindrical extension 10 of the cooled plate 4 can, in conjunction with the inner diameter of the cylinder liner 2, be embodied in such a way that a press fit results. In addition thereto, or alternatively, it is of course also possible to provide a seal between liner shoulder 9 and cooled plate 4. With regard to the screws 19 that are used, various configurations of the screw head are conceivable, whereby with the illustrated screw 19 having the overhanging head 19.1, appropriate recesses are provided in the cylinder head 14 shown in FIG. 1. If instead counter-sunk or flat-head screws are used, that side of the cylinder head 14 adjacent to the cooled plate 4 can be smooth in the region of the screws 19. The screws 19 are preferably equidistantly spaced from one another along the periphery of the cooled plate 4 and liner shoulder 9.

Although in the embodiment of a combustion chamber for high ignition pressures described in conjunction with FIGS. 1 to 6 the cylinder liner 2 is part of the combustion chamber, this is of course not mandatory. The arrangement shown in the figures and previously described can also be embodied without a cylinder liner; the combustion chamber is then formed by the cylinder bore, the cooled plate 4, and the piston 3. If for FIGS. 1 to 6 there is no liner, the cylinder liner that is designated with the reference numeral 2, and the liner shoulder that is designated with the reference numeral 9, would be integral components of the crankcase 5; in other respects, there is no change with regard to arrangement and function.

Figure 7:
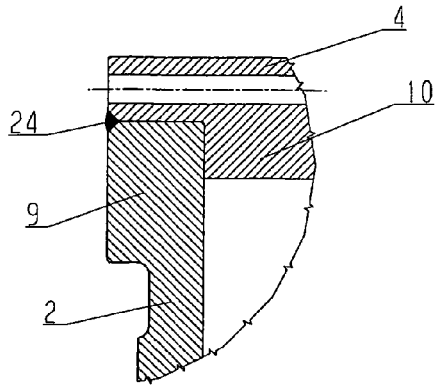
FIG. 7 is a second detailed illustration of the connection between cooled plate and liner.
Figure 8:
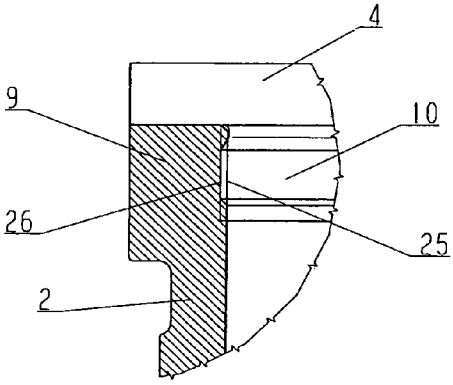
FIG. 8 is a third detailed illustration of the connection between cooled plate and liner.

Further possibilities for connecting the cooled plate 4 with the liner shoulder 9 of the cylinder liner 2 are shown in the detailed illustrations of FIGS. 7 and 8. Pursuant to the cross-sectional view of FIG. 7, the connection of the cooled plate 4 with the liner shoulder 9 is effected by welding. For this purpose, a continuous weld seam 24, or a weld seam that is interrupted numerous times over the periphery, for example a point-type weld seam, is provided along the outer periphery of the butt joint between cooled plate 4 and liner shoulder 9. In this connection, a point-type weld connection minimize the heat entry and hence the danger of distortion of the cylinder liner 2. The cylindrical extension 10 of the cooled plate 4 can also form a press fit together with the inner diameter of the liner shoulder 9, which in the case of an interrupted weld seam takes over the sealing function.

The cross-sectional illustration of FIG. 8 shows a further possibility of screw-connecting the cooled plate 4 with the liner shoulder 9, for which purpose an external thread 25 is provided on the cylindrical extension 10 of the cooled plate 4 and cooperates with an internal thread 26 on the rim of the liner shoulder 9 on the side of the cylinder head. By screwing the cooled plate 4 and the liner shoulder 9 together via the screw connection 25, 26, the connection of these two components is effected at the geometrical site that is favorable with regard to minimizing possible flexures of the cooled plate 4, namely directly at the combustion chamber boundary. With regard to sealing the combustion chamber 1, the screw connection 25, 26 furthermore acts like a labyrinth seal.

It is to be understood that the connections between the cooled plate 4 and the cylinder liner described in conjunction with FIGS. 6 to 8 are merely examples; many different connections between these two components are possible using means available to those of skill in the art, and in particular also between the cooled plate and the crankcase, when the combustion chamber has no cylinder liner.

In conjunction with the description of the bores 11.1-11.6 that form the cooling channels 11 it has already been discussed that they communicate with the cooling system of the internal combustion engine. This communication can be effected in different ways. Several possibilities for supplying the cooling channels 11 in the cooled plate 4 with coolant, or for discharging coolant therefrom, are shown by way of example in the detailed illustrations of FIGS. 9 to 11.

Figure 9:
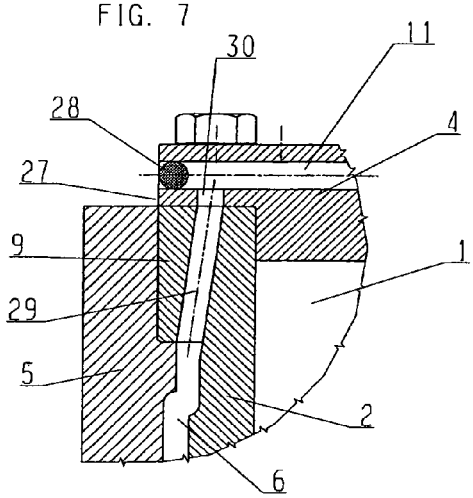
FIG. 9 is a detailed illustration of a coolant connection between crankcase and cooled plate.

In this connection, the cross-sectional view of FIG. 9 shows in a simplified manner the already known arrangement of cooled plate 4 and cylinder liner 2. The cylinder liner 2 is disposed in the cylinder bore in the crankcase 5, whereby to cool the walls of the combustion chamber 1 recesses 6 that convey coolant are formed between crankcase 5 and cylinder liner 2. The cooled plate 4 has a bore that forms a cooling channel 11 and extends radially inwardly from the peripheral side 27 of the cooled plate 4. The cooling channel 11 is closed off toward the peripheral side 27 by means of a pressed-in ball 28. The connection of the cooling channel 11 to the cooling system of the internal combustion engine is effected by a supply bore 29 that extends through the liner shoulder 9 of the cylinder liner 2 and is aligned with a connecting bore 30 in that edge region of the cooling plate 4 that rests upon the liner shoulder 9, whereby the connecting bore 30 opens into the cooling channel 11. It is to be understood that similar supply bores and also aligned connecting bores can be provided at multiple locations of the cooled plate 4 and can cooperate with corresponding cooling channels in order to ensure an efficient cooling.

Figure 10:
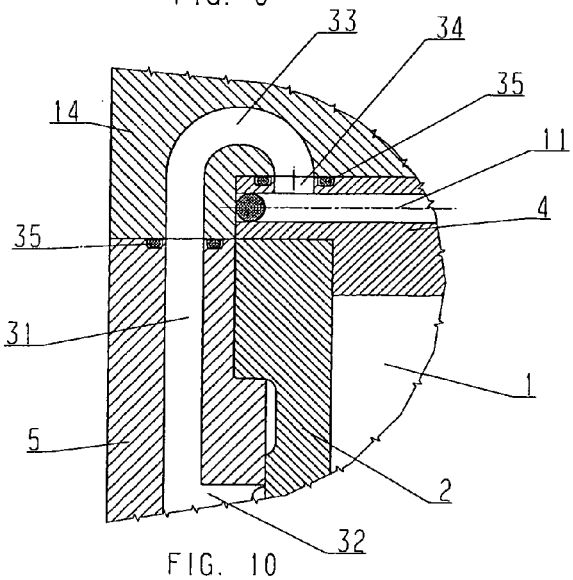
FIG. 10 is a second detailed illustration of a coolant connection between crankcase and cooled plate.

A further possibility for supplying coolant to the cooled plate 4 from the crankcase 5 is schematically shown in the cross-sectional view of FIG. 10. Here also the already described arrangement of cylinder liner 2 and cooled plate 4 is illustrated. This arrangement is on the one hand surrounded by the crankcase 5 and on the other hand by the cylinder head 14 that is disposed on the crankcase 5. A connecting channel 31 extends in the crankcase 5 from a coolant passage 32 that is disposed in the crankcase to the line of separation between cylinder head 14 and crankcase 5; there, the connecting channel 31 merges into a connecting channel 33 that is disposed in the cylinder head 14 and that in turn opens via a connection opening 34 into the cooling channel 11 that, similar to the embodiment of FIG. 9, is disposed in the cooled plate 4. To seal the transition between crankcase 5 and cylinder head 14 on the one hand, and cylinder head and cooled plate 4 on the other hand, sealing means 35 are provided. Also in this embodiment, similar coolant supply means to the cooled plate 4 can be provided at multiple locations.

Figure 11:
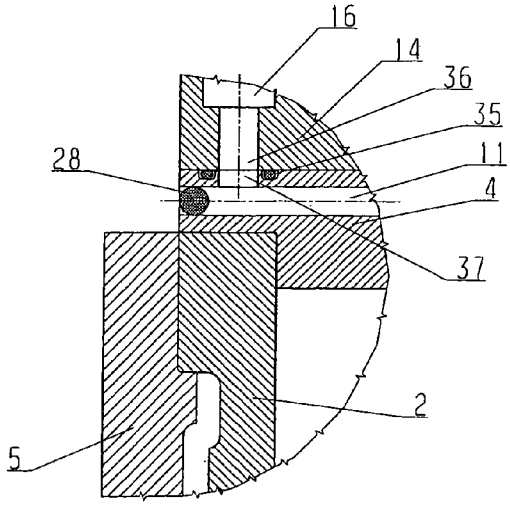
FIG. 11 is a detailed illustration of the coolant connection between cylinder head and cooled plate.

The cross-sectional view of FIG. 11 finally shows, in a simplified illustration, a supply of coolant to the cooled plate 4 from the cylinder head 14 of the internal combustion engine.

The illustrated arrangement also in this case includes a cylinder liner 2 with which the cooled plate 4 is connected in one of the previously described manners. The combination of cylinder liner 2 and cooled plate 4 is mounted in a cylinder bore in the crankcase 5 in such a way that the flat side of the cooled plate 4 that is on the cylinder head side is aligned with that side of the crankcase 5 that is adjacent to the cylinder head 14. For the supply of coolant, a connection between the coolant chamber 16 and the cooling channel 11 in the cooled plate 4 is provided from the coolant chamber 16, which is disposed in the cylinder head 14, via a connection opening 36 that extends to the cooled plate 4 and that is aligned with a coolant connection 37 in the cooled plate. The cooling channel 11, which proceeds from the peripheral side of the cooled plate 4 and is embodied in the form of a bore, is, as with the previously described embodiments, closed off by a pressed-in ball 28 in the vicinity of the peripheral side. To seal the connection location between cylinder head 14 and cooled plate 4, a sealing means 35 is disposed all the way around the coolant connection 37. As already described in conjunction with the embodiments of FIGS. 9 and 10, also in the embodiment of FIG. 11 a plurality of similar connections can be provided between the coolant chamber 16 in the cylinder head 14 and cooling channels 11 in the cooled plate 4.

For the embodiments described in conjunction with FIGS. 9 to 11, it is to be understood that for all of them the discharge of coolant from the cooled plate 4 to the crankcase 5 or to the cylinder head 14 can have the same configuration as does the supply of coolant in these embodiments, so that no separate illustration is provided for the discharge of coolant. Furthermore, it is of course conceivable to use combinations of different types of coolant supply or coolant discharge for the coolant provision of the cooled plate 4; here also it is not necessary to provide a separate illustration. The previously described principles of provision of coolant for the cooled plate 4 are of course equally suitable for internal combustion engines with or without cylinder liners. In the case of internal combustion engines having no liner, the cylinder liner 2 illustrated in the embodiments of FIGS. 9 to 11 merely becomes an integral component of the crankcase 5, so that also with regard to this aspect no separate illustration or description has been provided.

Figure 12:
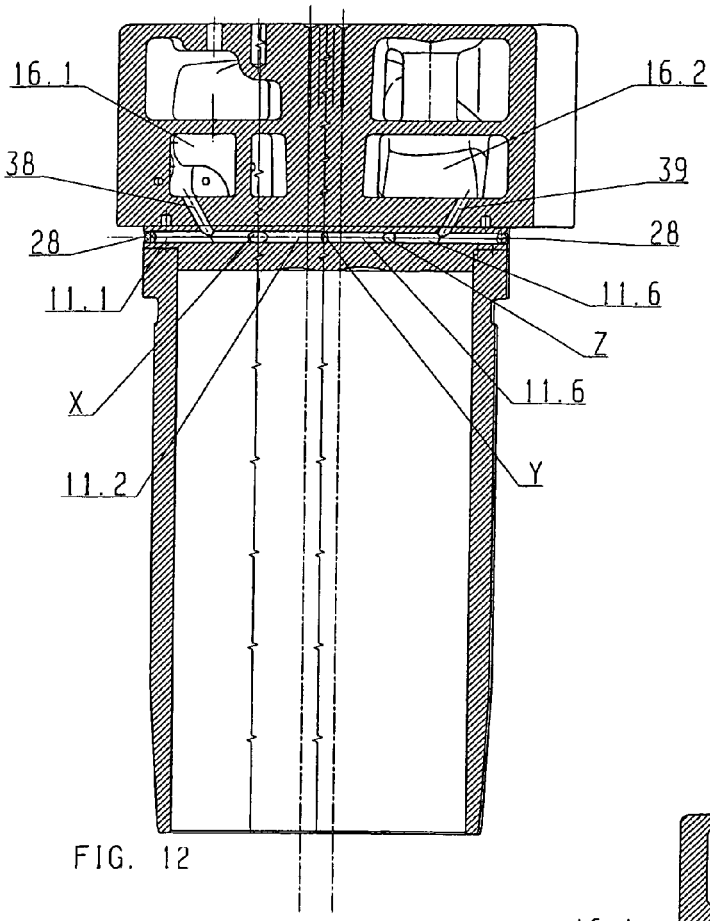
FIG. 12 is a cross-sectional illustration through the combustion chamber taken along the line D-D in FIG. 5.
Figure 13:
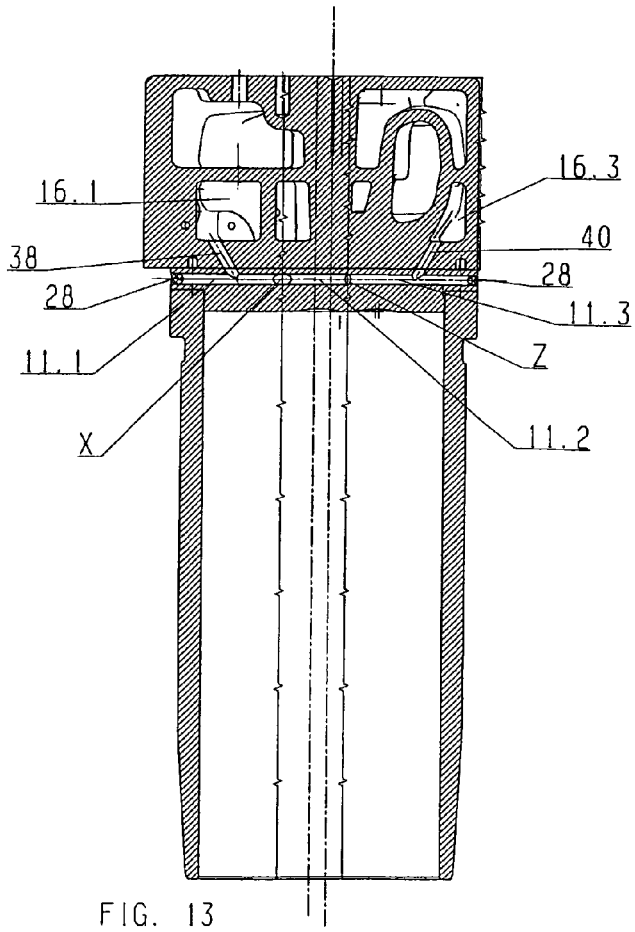
FIG. 13 is a detailed illustration through the combustion chamber taken along the line E-E in FIG. 5.

A connection of the cooled plate 4 pursuant to the embodiment of FIG. 5 to the cooling system in an arrangement according to FIG. 1 will be described in greater detail subsequently with the aid of the cross-sectional views of FIGS. 12 and 13. In this connection, FIG. 12 is a cross-sectional view taken along the line D-D in FIG. 5, and FIG. 13 is a cross-sectional view taken along the line E-E in FIG. 5. Since the arrangement was previously described in detail in conjunction with FIGS. 1 and 5, in the following only the connection between the coolant chamber 16 in the cylinder head 14 and the bores 11.1-11.6 that form the cooling channels 11 will be described.

FIG. 12, proceeding from a first cooling chamber 16.1, which is part of the coolant chamber 16 in the cylinder head 14, shows a feed bore 38 that connects the first coolant chamber 16.1 with the bore 11.1 in the cooling plate 4. The bore 11.1, which is closed off by a ball 28 toward the narrow side of the cooled plate 4, intersects the bore 11.2 at the point X, the further path of which is illustrated to the point Y in the drawing. At the point Y, the bore 11.2 intersects the bore 11.6, the path of which is shown in the right half of FIG. 12. The bore 11.6 intersects the bore 11.5 at the point Z and is closed off on the narrow side of the cooled plate 4 by a ball 28 that is pressed into the bore 11.6. By means of a discharge bore 39, a connection is established between the bore 11.6 and a second coolant chamber 16.2 in the cylinder head 14 that is disposed downstream of the first coolant chamber 16.1 and is also part of the cooling chamber 16.

FIG. 13 shows a cross-sectional orientation that deviates in parts from the illustration in FIG. 12 and follows the line E-E in FIG. 5. Since the cross-sectional orientation is identical with the cross-sectional orientation in FIG. 12 up to the point of intersection Y, for this purpose reference is made to the previous description of FIG. 12. At the point Y, the bore 11.2 intersects not only the bore 11.6 but also the bore 11.3, the path of which is illustrated in the right half of FIG. 13. The bore 11.3 is also closed off in the vicinity of the peripheral side with the ball 28. For the discharge of the coolant from the cooled plate 4, a further discharge bore 40 is provided which connects the bore 11.3 with a third coolant chamber 16.3, which is also part of the coolant chamber 16 and is disposed downstream of the coolant chamber 16.1.

Similar to the connection of the coolant chamber 16 to the cooling channels 11 in the cooled plate 4 described in conjunction with FIGS. 12 and 13, the connection of the remaining bores 11.2, 11.4, 11.5 illustrated in FIG. 5 are also to be realized, so that no explicit illustration is provided herefor; it is merely to be noted that the bores 11.1 and 11.2 are coolant supplies and the bores 11.3, 11.4, 11.5, 11.6 are coolant discharges, and accordingly the feeding of the coolant supplies is effected from portions of the coolant chamber 16 in the cylinder head 14 that are disposed upstream to those portions of the cooling chambers 16 into which the coolant discharges are returned.

With regard to the layout of the arrangement described in conjunction with FIGS. 1, 5, 12 and 13, it is to be noted that the connections or connecting bores 21 between the individual portions of the coolant chamber 16 (FIG. 1) and the connections between the coolant chamber 16 and the coolant channels 11, are embodied in such a way that a heat dissipation results that is staggered in conformity with the thermal stress of the cooled plate 4 and cylinder head 14; in this connection, the thermal stress, and hence also the thermal dissipation, is the greatest at the combustion chamber boundary and decreases as the distance from the combustion chamber increases.

It should furthermore be noted with respect to the embodiment previously described in conjunction with FIGS. 1, 5, 12 and 13 that the connection of the cooled plate 4 with the liner shoulder, or with the crankcase where the internal combustion engine has no liner, requires that the valve seats of the gas-reversing valves 13 be associated with the crankcase 5 in the assembled state; in contrast, the valve guides are disposed in the cylinder head 14. This configuration results in increased requirements on the precision of assembly of the cylinder head 14 to the crankcase 5. In particular, cumulative manufacturing tolerances mean that at least with large-volume engines for commercial vehicles, no continuous cylinder heads should be used, rather those that span one or two cylinders.

For an exact mounting of the cylinder head relative to the cooled plate 4 or to the cooled plates 4 when the cylinder head spans several cylinders, adjustment measures, such as adjusting pins, are required.

Entirely new possibilities with regard to the selection of the material result due to the separation of the combustion chamber sealing from the cylinder head. The cooled plate 4 can be made of a high-strength metal alloy, for example high-strength forged steel, which could not be used for conventional cylinder heads due to structural, manufacturing and financial reasons. In contrast, due to the low stressing relative to conventional cylinder heads, the cylinder head can be made of more ordinary materials, such as aluminum, which in addition to cost advantages also has advantages with regard to weight.

With a suitable selection of the material, the valve seats for the gas-reversing valves 13 can be formed directly in the cooled plate, so that the pressing of valve seat rings can be eliminated. As a result, with a four valve engine as used these days, not only are four components eliminated per cylinder, with a six-cylinder engine this means that 24 components are eliminated; rather, in particular the stresses caused by the pressing of valve seat rings into conventional cylinder heads are avoided. These stresses, which are even more intensified by the heat entry during the combustion process, contribute to a great extent to the creation of the aforementioned web or element cracks.

The separation of the combustion chamber seal from the cylinder head further enables or simplifies measure at the top of the combustion chamber that reduces wear and/or increase efficiency.

Figure 14:
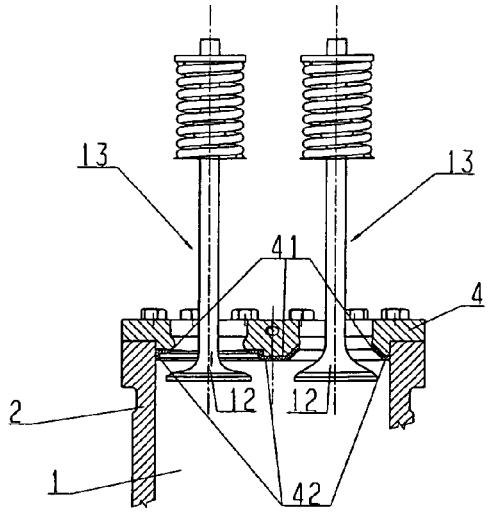
FIG. 14 is a cross-sectional illustration through the combustion chamber with a layered cooled plate taken along the line F-F in FIG. 3.

On such measure is illustrated in FIG. 14, which is a partial cross-sectional view taken along the line F-F in FIG. 3. This illustration also proceeds from a cooled plate 4 that is screw-connected with the liner shoulder 9 of a cylinder liner 2, whereby the cylinder liner 2, cooled plate 4 and piston 3 (FIG. 1) form the combustion chamber 1. In order on the one hand to prevent the thermal entry brought about by the combustion processes into the cooled plate 4, and on the other hand to minimize the wear caused by the wear processes of the valve heads 12 on the valve seats 41, that side of the cooled plate 4 that covers the combustion chamber 1 may be provided with a ceramic coating 42. Such ceramic coatings can be applied in many different ways; the methods used for this purpose are known to those of skill in the art. Of course, other coatings besides ceramic coatings are conceivable.

Figure 15:
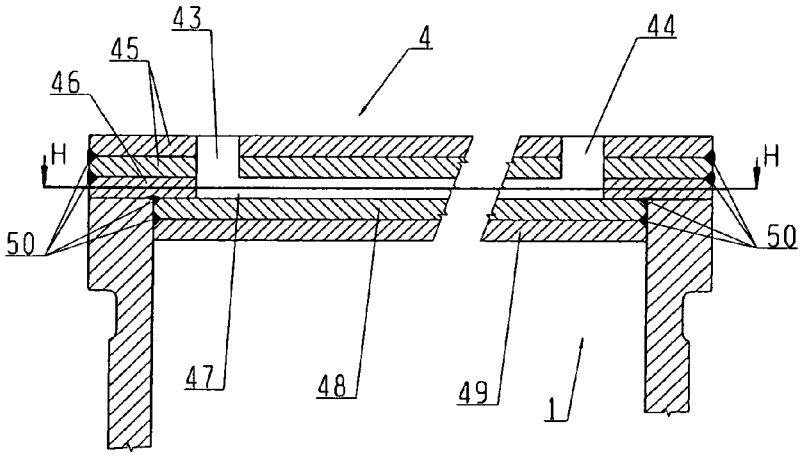
FIG. 15 is a cross-sectional illustration through a cooled plate showing the layer build-up taken along the line G-G in FIG. 16.
Figure 16:
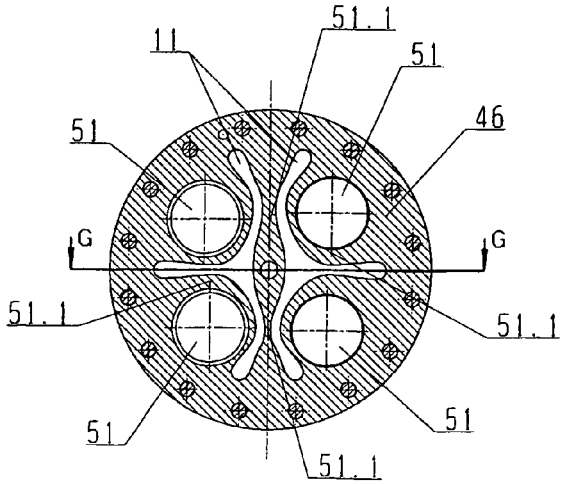
FIG. 16 is a cross-sectional illustration through a cooled plate showing the layer build-up taken along the line H-H in FIG. 15.

In order to achieve different material properties in different planes of the cooled plate, there is a possibility, as shown in the partial cross-sectional view of FIG. 15 taken along the line G-G (FIG. 16), of building up the cooled plate 4 from layers. In this connection, a first set composed of two layers 45 is provided, whereby the two layers are comprised of metal plates that form a composite that is resistant to bending and contain not only feed openings 43 but also discharge openings 44, via which the coolant can be fed from or discharged to the cylinder head 14, similar to the embodiment of FIG. 11. Adjoining the two layers 45, in the direction toward the combustion chamber 1, is a third layer 46 that includes recesses 47, for example in the form of free stampings. The recesses 47 correspond with the feed openings 43 and the discharge openings 44, and form the cooling channels of the cooled plate 4. With regard to the selection of the material for the third layer 46, ease of processing can govern, because this layer 46, due to the presence of the recesses 47, cannot contribute much to the resistance to bending of the composite anyway. The fourth layer 48, as viewed in the direction toward the combustion chamber 1, as are the first two layers 45, is also comprised of a material having a high resistance to bending, whereas the fifth layer 49, as viewed in the direction toward the combustion chamber, has a great hardness and a low thermal conductivity. Formed in this fifth layer 49 are the valve seats for the gas-reversing valves (not illustrated in FIG. 15). The connection of the parallel plates 45, 45, 48, 49 to one another is effected in the illustrated embodiment by weld connections 50 along the periphery of the parallel plates; however, other possibilities for joining the parallel plates to a unit that forms the cooled plates are also conceivable. The configuration of the cooled plates as a stack of parallel plates, in addition to the possibility of realizing specific material properties in specific planes of the cooled plates, has the further advantage that the cooling channels can be produced particularly easily, for example by a simple free stamping, and even in complicated shapes and distributed over a plurality of planes of the cooled plates. FIG. 16, in a cross-sectional view through the layer 46 along the line H-H (FIG. 15), shows one embodiment having cooling channels 11 that are freely stamped out of the layer 46. As is recognizable in the illustration, the cooling channels 11 are slightly spaced from valve openings 51 in the region of the valve lands 51.1, and optimize the cooling effect in this region. In addition to the previously described free stamping of the cooling channels, these cooling channels can also be formed in the parallel plates so as to be recessed in a relief-like manner.

As previously described, in particular in conjunction with FIG. 1, either one continuous cylinder head that is associated in common with all combustion chambers, or a plurality of cylinder heads respectively associated with at least one combustion chamber, are provided, whereby the cylinder head or heads merely contain the gas-reversing channels, the cooling channels, the guides for the gas-reversing valves, and the receiving means for the injection valves. The control and actuating mechanisms for the gas-reversing valves as well as for the injection valves, which in conventional engine constructions are generally contained in the cylinder head or heads, are, as illustrated in the cross-sectional view of FIG. 17 taken along the line A-A (FIG. 3), disposed in a control and actuating module, which is common to all of the combustion chambers. Since the illustration of FIG. 17 differs from the illustration of FIG. 1 only by the presence of the control and actuating module 52, which adjoins the cylinder head 14 on that side thereof that faces away from the combustion chamber 1, in the following only those portions of the illustration that are new will be described. For the remaining portions of the drawing, for which also the same reference numerals as in FIG. 1 have been used, reference is made to the description of FIG. 1.

The control and actuating module 52 includes a support 53 that is common to all of the combustion chambers, and hence also to all of the cylinder heads 14. A camshaft 55 is rotatably mounted on the support 53 in a trough-shaped portion 54 thereof. The camshaft 55 is driven in a conventional manner by a non-illustrated gear mechanism that is driven by the crankshaft 8; in this connection, the gear arrangement can, for example, be a toothed gear, a chain or a toothed belt. The cam 56 of the camshaft 55 acts in a known manner upon the rocker arm 57, which is rotatably disposed on a shaft 58 mounted in the common support 53 in such a way that the cams 56 of the camshaft 55 act upon the ends 57.1 of the rocker arm 57 on the cam side. As a consequence, the ends 57.2 of the rocker arm 57 on the valve side actuate the gas-reversing valves 13 via valve bridges 59, and thereby open or close the gas-reversing channels (not illustrated) via the valve heads 12.

Supplying the combustion chambers with fuel is effected via injection valves 60 that are disposed in the cylinder head 14 and that are connected with an injection unit (not illustrated) by means of tubular connections (also not illustrated). The injection unit can, for example, be a Common Rail Injection System. Actuation of the injection valves is effected via an electronic control (not illustrated) in an electrical manner, as is conventional with Common Rail Injection units. To supply the lubrication locations, a central lubricant bore 61 is provided that is supplied with lubricant from the lubricant system of the internal combustion engine (not illustrated), and in turn is connected directly or indirectly with the lubricant locations in the control and actuating module 52 via lubricant channels (not illustrated). Excess lubricant is collected in the common support 53 and is returned to the oil sump of the internal combustion engine (not illustrated) via a return line (also not illustrated).

Provided for enclosing the components disposed on the common support 53 is a cover 62 that is screw-connected with the common support 53 and closes off the interior of the control and actuating module 52 relative to the surrounding atmosphere. The securement of the cover 62 on the common support 53 is effected by screws or bolts (not illustrated); the common support 53 is in turn secured to the cylinder head or heads 14 via screws or bolts (also not illustrated).

It is to be understood that the previous description of the mechanism for actuating the gas-reversing valves and the injection valves is provided by way of example only. The actuation arrangement for the gas-reversing valves can, of course, also be an electronically controlled arrangement that individually actuates the gas-reversing valves via electrically or hydraulically controlled actuators. Similarly, the described Common Rain Injection System is only one possible configuration; for example, a pump/nozzle system or a pump/conduit/nozzle system could of course also be used.

The separation of the cylinder head also provides new possibilities with regard to the selection of material in conjunction with the previously described control and actuating module. For example, it is conceivable to produce the common support 53 of a lightweight metal or a fiber-reinforced polymeric material as an injection molded component, which in addition to having weight advantages also provides a significant simplification of the manufacturing.

Depending upon the material used for the common support, or the manufacturing process utilized, further functional components can additionally also be monolithically formed therewith. For example, it is conceivable to integrate the intake manifold and/or coolant tubes into the common support for the connection of the cylinder head or heads to the cooling system of the internal combustion engine.

Figure 17:
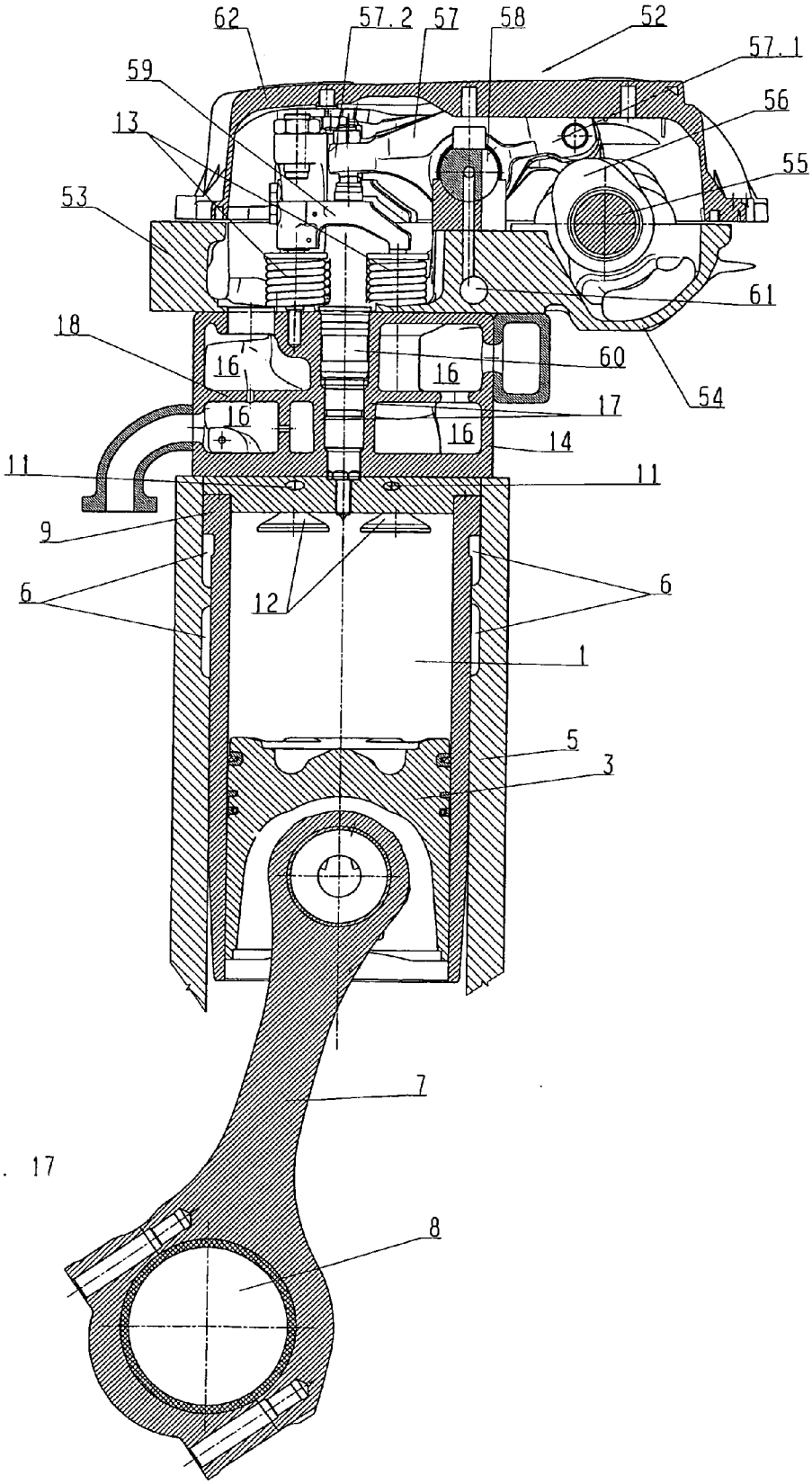
FIG. 17 is an illustration of the combustion chamber of FIG. 1 with a control and actuating module placed thereon.

The control and actuating module 52 previously described in conjunction with FIG. 17 does not, of course, necessarily have to be separated from the cylinder head 14; the functionality of the control and actuating module can, of course, under certain conditions also be integrated into the cylinder head. For example, where the camshaft is disposed below, in other words push rod actuated rocker arms and individual cylinder heads, it would be advantageous to integrate the actuating arrangement for the gas-reversing valves into the cylinder heads, as is customary with such constructions.

A number of modifications and configurations that deviate from the previously described example are conceivable, and starting from the basic inventive concept could be derived by one of skill in the art. Thus, the previously described arrangements are presented by way of example only.

The specification incorporates by reference the disclosure of German priority document 10 2005 048 566.9.

The present invention is, of course, in no way restricted to the specific disclosure of the specification and drawings, but also encompasses any modifications within the scope of the appended claims.

We claim:

1. A compression ignition internal combustion engine having at least one combustion chamber for high ignition pressures, wherein each combustion chamber comprises a cylinder bore disposed in a crankcase of the internal combustion engine or a cylinder liner disposed in the cylinder bore, a piston that is guided in the cylinder bore or cylinder liner, and a cylinder head disposed across from said piston, wherein spaces that are adapted to convey coolant are disposed in the crankcase such that coolant can flow about a portion of walls of the cylinder bore or cylinder liner on a side remote from said combustion chamber, wherein said cylinder head is associated with at least one of said combustion chambers and is provided with coolant chambers through which coolant is adapted to flow, wherein gas-reversing valves, at least one injection valve, and guides for at least one inlet valve and at least one outlet valve are disposed in said cylinder head for each combustion chamber, wherein the internal combustion engine further comprises a separate cooled plate that is disposed between said combustion chamber and said cylinder head, forms a surface cover of said combustion chamber and is connected in a positively engaging and gas tight manner with the crankcase and/or the cylinder liner, wherein valve seats for the at least one inlet valve and at least one outlet valve are disposed in said cooled plate, wherein the at least one injection valve is adapted to extend through said cooled plate, wherein said cooled plate, on a side that faces said combustion chamber, is provided with a cylindrical extension having an outer diameter that corresponds essentially to an inner diameter of said combustion chamber, and wherein in an installed state of said cooled plate, said cylindrical extension is disposed within the cylinder bore or cylinder liner such that said cooled plate extends about an upper inner edge of the cylinder bore or cylinder liner in an angular manner.

2. An internal combustion engine according to claim 1, wherein said cooled plate is connected with the crankcase and/or the cylinder liner as close to an edge of said combustion chamber as possible.

3. An internal combustion engine according to claim 2, wherein said cooled plate is cooled via said coolant.

4. An internal combustion engine according to claim 1, wherein cooling channels are provided in said cooled plate.

5. An internal combustion engine according to claim 1, wherein said cooling channels are bores that extend through said cooled plate, each proceeding from a peripheral side of said cooled plate.

6. An internal combustion engine according to claim 5, wherein at least a portion of said bores are disposed such that they intersect one another and form a connected system of bores, or wherein at least a portion of said bores that proceed from the peripheral side of said cooled plate are again closed off toward said peripheral side.

7. An internal combustion engine according to claim 1, wherein feed openings and/or discharge openings for said coolant are provided in a peripheral side of said cooled plate and/or in an overlapping edge portion of a flat side of said cooled plate that forms a cover surface of said combustion chamber and/or of the fiat side of the cooled plate opposite the cover surface, wherein feed of said coolant is effected directly into said cooled plate and/or via said cylinder head into said cooling plate and/or via the crankcase into said cooled plate, and wherein discharge of said coolant is effected directly out of said cooled plate and/or out of said cooled plate into said cylinder head and/or out of said cooled plate into the crankcase.

8. An internal combustion engine according to claim 1, wherein an end of said cylinder liner that faces said cylinder head is provided with a circumferential liner shoulder that is supported on an upper edge of the cylinder bore or on a circumferential abutment provided in the cylinder bore.

9. An internal combustion engine according to claim 7, wherein said feed openings and discharge openings are bores in said cooled plate that correspond with appropriate openings in said cylinder head or in a liner shoulder of said cylinder liner or in the crankcase or in a separate coolant distribution tube, and wherein cooling channels in said cooled plate connect with said coolant chambers in said cylinder head or with said spaces in the crankcase that are adapted to convey coolant or with the coolant distribution tube.

10. An internal combustion engine according to claim 9, wherein sealing means are provided in a respective transfer region of coolant between said cooled plate and said cylinder head or said cooled plate and said liner shoulder or said cooled plate in the crankcase or said cooled plate and the coolant distribution tube.

11. An internal combustion engine according to claim 1, wherein said cooled plate is made of a high-strength metal alloy, or wherein valve seat rings are disposed in said cooled plate, or wherein valve seats are formed in said cooled plate.

12. An internal combustion engine according to claim 1, wherein said outer diameter of said cylindrical extension relative to said inner diameter of the cylinder bore or cylinder liner is such that a press fit results.

13. An internal combustion engine according to claim 1, wherein a combustion chamber seal is disposed between a portion of said cooled plate that overlaps an edge of said combustion chamber and a portion of the crankcase and/or the cylinder liner that is disposed across from said overlapping portion of said cooled plate.

14. An internal combustion engine according to claim 1, wherein said cooled plate is secured to the crankcase or the cylinder liner by means of screws, or wherein said cooled plate is welded to said cylinder liner.

15. An internal combustion engine according to claim 14, wherein said screws are disposed concentric to an axis of said combustion chamber and are essentially equidistantly spaced from one another when viewed in a circumferential direction.

16. An internal combustion engine according to claim 1, wherein said cooled plate is threadedly connected with said cylinder liner via an internal thread on an upper edge of said shoulder liner and an external thread on a periphery of said cylindrical extension.

17. An internal combustion engine according to claim 1, wherein said cylinder liner has a liner shoulder, and wherein said cooled plate has an outer diameter that corresponds essentially to an outer diameter of said shoulder liner.

18. An internal combustion engine according to claim 1, wherein a surface of said cooled plate that is adjacent to said combustion chamber is provided with a coating having a low heat conductivity and/or high resistance to wear.

19. An internal combustion engine according to claim 1, wherein said cooled plate is composed of a plurality of plate-shaped layers that extend parallel to a top of said combustion chamber to form a set of plates, wherein at least one of said parallel plates that is disposed in the interior of said set of plates is provided with recesses that via coolant feeds and coolant discharges are disposed in a coolant system of the internal combustion engine, and wherein said parallel layers of said set of plates are connected to one another.

20. An internal combustion engine according to claim 19, wherein at least one of said parallel layers has material properties that are different from the remainder of said parallel layers.

21. An internal combustion engine according to claim 1, wherein a plurality of cylinder heads are provided, each having associated therewith at least one combustion chamber, or wherein a single cylinder head is provided that is associated in common with all combustion chambers.

22. An internal combustion engine according to claim 1, wherein said cylinder head is adapted to apply pressure to at least a central portion of said cooled plate.

23. An internal combustion engine according to claim 1, wherein partitions 17,18 are disposed in said cylinder head and divide said coolant chambers, wherein said partitions are disposed at least perpendicular to a fiat side of said cooled plate, and wherein said cylinder head has a structure that is resistant to bending in a direction toward said combustion chamber.

24. An internal combustion engine according to claim 1, wherein said cylinder head is made of a light metal alloy.

25. An internal combustion engine according to claim 1, wherein at least one control and actuating module is disposed on a side of said cylinder head that faces away from said combustion chamber, and wherein said at least one control and actuating module is provided with a common support that contains at least actuating devices for said inlet and outlet valves and the injection nozzles for said combustion chambers.

26. An internal combustion engine according to claim 25, wherein said common support contains at least one camshaft, or wherein a cover is disposed on the said common support via which actuation and control elements are accessible, or wherein a lubricating oil feed or return is disposed on said common support.

27. An internal combustion engine according to claim 25, wherein said at least one control and actuating module is secured via detachable connections to said cylinder head, or wherein said at least one control and actuating module is made at least partially of polymeric material, or wherein an intake manifold that is common to all combustion chambers is disposed on said at least one control and actuating module.

* * * * *